US010954646B2

(12) United States Patent
Cerda

(10) Patent No.: US 10,954,646 B2
(45) Date of Patent: Mar. 23, 2021

(54) END FRAME FOR USE WITH TRENCH SHIELD

(71) Applicant: CWS Roadplate, LLC, Houston, TX (US)

(72) Inventor: Victor Cerda, Houston, TX (US)

(73) Assignee: CWS ROADPLATE, L.L.C., Houston, TX (US)

( * ) Notice: Subject to any disclaimer, the term of this patent is extended or adjusted under 35 U.S.C. 154(b) by 0 days.

(21) Appl. No.: 16/732,597

(22) Filed: Jan. 2, 2020

(65) Prior Publication Data

US 2020/0217035 A1 Jul. 9, 2020

Related U.S. Application Data

(60) Provisional application No. 62/788,488, filed on Jan. 4, 2019.

(51) Int. Cl.
*E02D 17/08* (2006.01)
*E02D 5/22* (2006.01)
*E02D 5/24* (2006.01)

(52) U.S. Cl.
CPC ..... *E02D 17/08* (2013.01); *E02D 5/226* (2013.01); *E02D 5/24* (2013.01)

(58) Field of Classification Search
CPC combination set(s) only.
See application file for complete search history.

(56) References Cited

U.S. PATENT DOCUMENTS 3,159,978 A * 12/1964 De Lillo ..... E02D 17/08 405/282
3,606,757 A * 9/1971 Weese et al. ..... E02F 5/10 405/283
3,866,425 A * 2/1975 Morrice ..... E02D 5/16 405/274
4,022,420 A * 5/1977 Pace ..... E04G 9/06 249/194
4,059,964 A * 11/1977 Pavese ..... E02D 17/08 405/282
4,202,649 A * 5/1980 Cook ..... E02D 17/08 405/282
4,659,260 A * 4/1987 Morelli ..... E02D 17/08 405/272
5,533,838 A * 7/1996 Kundel ..... E02D 17/08 405/276
7,559,724 B1 * 7/2009 Olen ..... E02D 17/08 405/272
10,501,906 B2 * 12/2019 Spry ..... E02D 17/083

* cited by examiner

*Primary Examiner* — Kyle Armstrong
(74) *Attorney, Agent, or Firm* — Patrick K. Steele

(57) ABSTRACT

An end frame includes a guide having a channel therethrough for receiving a sheet piling and a pair of hangers for hanging the end frame from a spreader of a trench shield. The end frame hangs from the spreader and bears against the adjacent ends of the sidewalls of the trench shield to provide a channel through which sheet piling can be inserted and stabilized as the sheet piling is driven into the soil adjacent to the end of the trench shield. The sheet piling and the end frame prevent unwanted cave-ins of soil into the workspace between the sidewalls of the trench shield without imparting unwanted buckling forces to the midsection of the spreader from which the end frame hangs. The hangers may be rigidly coupled to the guide or they may be coupled to the guide through chains, cables, straps or through pivoting linkages.

19 Claims, 6 Drawing Sheets

END FRAME FOR USE WITH TRENCH SHIELD

STATEMENT OF RELATED APPLICATIONS

This application depends from and claims priority to U.S. Provisional Application No. 62/788,488 filed on Jan. 4, 2019.

BACKGROUND

Field of the Invention

The present invention relates to trench shields for protecting utility workers that enter excavated trenches to protect them from cave-ins. More specifically, the present invention relates to an end frame that can be used to prevent cave-ins from pouring unsettled soil into an open end of a trench shield.

Background of the Related Art

Trench shields (also called trench boxes) are used for protecting utility workers while performing their duties within a trench and avoid cave-ins. They are customarily constructed with two parallel sidewalls of varying thicknesses held apart by a plurality of spreaders. Spreaders can be interchanged to match the width of the trench. Spreaders may be either extendable using fluid cylinders. The different materials, soils and building designs lead to a variety of trench shield depth ratings, i.e. the depth of a trench in that soil that the trench shield can withstand without a collapse and without buckling. Depth ratings are determined by registered professional engineers using soil load analysis and data that can be obtained from analysis of the soil in which the trench is to be dug.

A problem with conventional trench shields is that they are open-ended. Some contractors install make-shift fences or barriers made up of a plurality of pieces of lumber that bear against the trench shield spreaders that maintain the sidewalls of the trench shield in a spaced-apart relationship one to the other. A considerable amount of force may be applied to these make-shift fences or barriers that cause an unsafe load to be applied to the spreaders, creating a safety hazard as the spreaders are not designed for sustaining a lateral loading that may promote buckling.

BRIEF SUMMARY

One embodiment of the present invention provides an end frame for use with a conventional trench shield, the end frame comprising a guide through which sheet pilings can be driven into soil adjacent to an end of a trench shield to which the end frame is coupled and from which the end frame is supported. The end frame transfers forces applied by unsettled soil adjacent to an end of a trench shield against the ends of the sidewalls of the trench shield so the reactive load is borne by the ends of the trench shield sidewalls rather than by the trench shield spreaders that maintain the sidewalls in their spaced-apart and parallel positions within an earthen trench. The guide is supported in position at the end of the trench shield by hangers that are hung off of a spreader of the trench shield that is adjacent to the ends of the trench shield against which the end frame bears when loaded. Optionally, the hangers are disposed into connection with the spreader of the end frame at positions that are immediately adjacent to the sidewalls so that no load is applied to the spreader mid-section. This targeted position of the hangers of the end frame prevents unwanted buckling of the spreader and possible resulting collapse of the trench shield. The hangers may be disposed on the ends of the spreader very close to the sidewalls so as to impart any hanging force imparted to the spreader by the end frame onto robust spreader supports that protrude inwardly into the work space from the sidewalls for being received into the end of the tubular spreader supported thereon. Embodiments of the end frame of the present invention include a guide that is longer than the width of the trench shield interior work space to ensure that a load imparted to the end frame by sheet pilings passing through the guide and by soil loading bearing against the sheet pilings and/or the end frame is opposed by the reactive force of the ends of the sidewalls of the trench shield against the guide of the end frame, and not by the spreader of the trench shield from which the end frame is hung.

One embodiment of the end frame of the present invention includes an adjustable guide that can be adjusted in width to accommodate sheet pilings of varying shapes and widths. In one embodiment, the guide includes a first member that has an engaging surface thereon for engaging the ends of the sidewalls of the trench shield, a second member that is disposed in a parallel arrangement relative to the first member, and a pair of adjustable links that couple a first end of the first member to the first end of the second member, and that couple the second end of the first member to the second end of the second member. In one embodiment, an adjustable link comprises a linking plate that has a first column of fastener components for securing a first side of the linking plate to the first end of the first member and a second column of fastener components for securing the second side of the linking plate to a first end of the second member. Similarly, the other adjustable link comprises a linking plate that has a first column of fastener components for securing a first side of the linking plate to the second end of the first member and a second column of fastener components for securing the second side of the linking plate to a second end of the second member. In one embodiment, the adjustable links may each comprise a larger linking plate that includes three columns of fastener components so that the same linking plate can be used to connect the first ends (or the second ends) of the first member and the second member at a first width or at a second, larger width to accommodate a sheet piling have a larger profile, as will be explained in further detail below. In one embodiment, a column of fastener components may comprise a column of threaded bolts for being received into apertures or holes along the first end of the first member and along the first end of the second member of the guide, and also along the second end of the first member and along the second end of the second member of the guide. In another embodiment, a column of fastener components may comprise a column of apertures or holes for received threaded bolts along the first end of the first member and along the first end of the second member of the guide, and also along the second end of the first member and along the second end of the second member of the guide.

In other embodiments, an adjustable link may comprise a tongue and groove coupling wherein the linking plate includes a groove along a first side and a groove along a second side in the place of the column of fastener components, and the guide of the end frame includes a tongue shaped for being received into the groove, the tongue disposed along a first side of the first member and also along the first side of the second member. Similarly, a tongue would also be disposed along the second side of the first member of the guide and along the second side of the second member of the guide. The linking plate would be slidably coupled to the first member and the second member by holding the first member and the second member in position parallel and spaced apart from one another, and the linking plate would be slidably engaged, using the grooves, to the first member and the second member at the elongated tongues thereon.

In other embodiments, the adjustable links could comprise one or more tubes extending perpendicular to the first member and from the first end of the first member towards the first end of the second member and a corresponding one or more tubes extending perpendicular to the second member and from the first end of the second member towards the first end of the first member, the tubes extending from the second member towards the first member being either larger in diameter than or smaller in diameter than the tubes extending from the first member so that the tubes extending from the second member can be received over or within the tubes from the first member. All of the tubes include pairs of holes drilled through the tube so that a pair of holes of a tube extending from the first member may be aligned with a pair of holes in a tube extending from the second member and a bolt, shaft or nail can be inserted to secure the tube extending from the first member to the tube extending from the second member to secure the first end of the first member to the first end of the second member. It will be understood that a similar arrangement of tubes can be provided on the second end of the first member and the second end of the second member to secure the second end of the first member to the second end of the second member. To adjust the width of the channel of the end frame, the bolt, shaft or nail can be removed from each of the tubes, the tube extending from the second member can be slid further into or from the tube from the first member (or the tube extending from the second member can be slid further over or off of the tube from the first member) to vary the length of the adjustable link comprising the tubes and to thereby vary the width of the channel through the guide of the end frame to accommodate sheet pilings of varying profiles.

A large variety of adjustable links can be used to vary the width of the channel of the guide of the end frame of the present invention without departing from the spirit and scope of the claims appended hereto. Similarly, the adjustable links can be coupled to the first member and the second member in a large variety of ways without departing from the spirit and scope of the claims appended hereto. A variety of clamps, straps, buckles, belts, fasteners, ties, couplings, latches, hitches, turnbuckles and other devices typically used for coupling one structure to another can be adapted for securing and for adjustably securing the first end of the first member to the first end of the second member and the second end of the first member to the second end of the second member to form a width-adjustable guide of an end frame of the present invention, and those devices and adaptations are incorporated into the disclosure hereof.

Similarly, hangers can be coupled to the guide of the end frame in a large variety of ways. The may be rigidly coupled, pivotally coupled, or coupled through a flexible connection such as, for example, a strap, a chain, a cable, etc. In one embodiment, the hangers that are used to engage a spreader of the trench shield and to support the end frame at the end of the trench shield can be connected using a more complex linkage such as, for example, a parallelogram linkage that ensures alignment of the channel of the guide with the first ends of the sidewalls of the trench shield to be engaged by the load surfaces of the first member. In other embodiments, gravity will ensure alignment of the channel of the guide of the end frame with the first ends of the sidewalls of the trench shield from which the end frame is supported by the hangers.

Embodiments of the end frame of the present invention can be used singularly, or one at a time at the end of a trench shield, or they may be used redundantly. In one embodiment, the hangers may be coupled to the guide of the end frame using adjustable-length straps, chains or cables so that a first end frame can be hung in a position above a second end frame therebelow. This arrangement may be used on trench shield systems that include stacked trench shields for deep trench protection.

DETAILED DESCRIPTION

Figure 1:
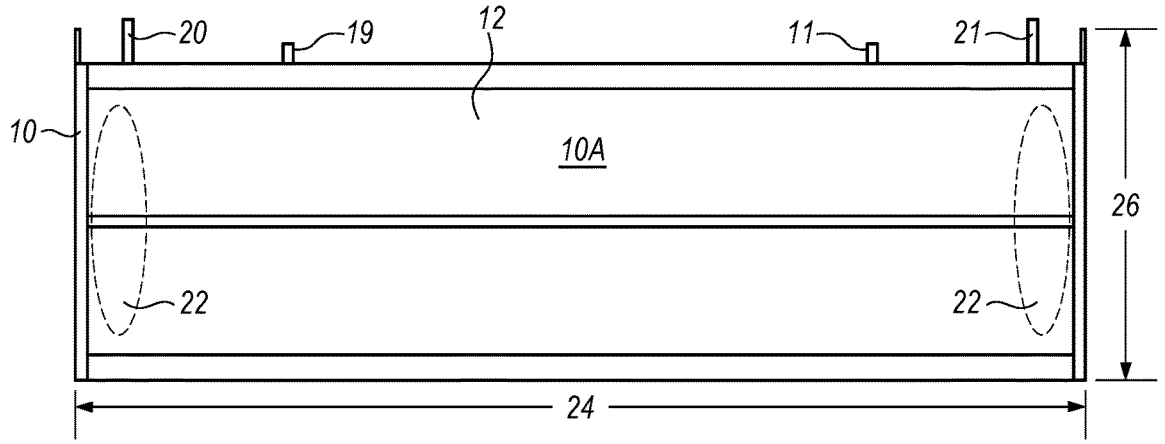
FIG. 1 is a front elevation view of an embodiment of the end frame of the present invention.

FIG. 1 is a frontal elevation view of an embodiment of the end frame 10 of the present invention. The end frame 10 of FIG. 1 has a guide 10A. The guide 10A of the end frame 10 has a length 24 and a height 26. The guide 10A is coupled to a first hanger 20 and to a second hanger 21 that is spaced-apart from the first hanger 20. Optionally, the end frame 10 further includes lift eyes 11 and 19 connected to the guide 10A of the end frame 10 for being connected to chains or cables (not shown) for use in lowering and lifting the end frame 10 into and from a trench (not shown) using, for example, a piece of heavy equipment. FIG. 1 further shows the location of a pair of load surfaces 22 disposed on a first member 12 of the guide 10A that, when the end frame 10 is hung onto a spreader of a trench shield (not shown), as illustrated in later drawings and discussed below, the load surfaces 22 on the guide 10A engage and bear against the ends of the sidewalls of the trench shield.

Figure 2:
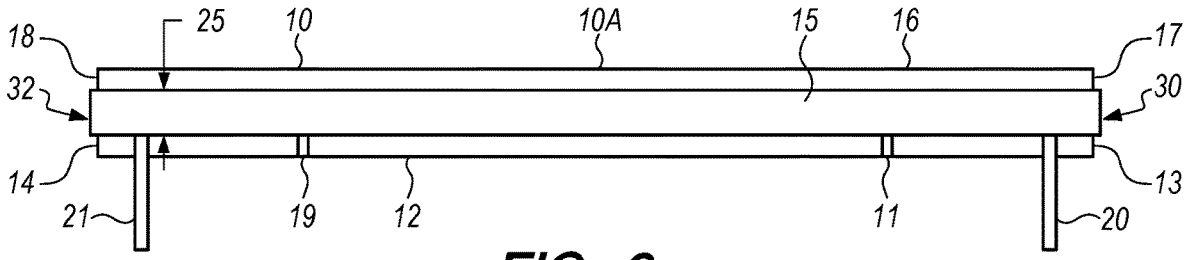
FIG. 2 is a plan view of the embodiment of the end frame of FIG. 1.

FIG. 2 is a plan view of the end frame 10 of FIG. 1. The guide 10A of the end frame 10 of FIG. 2 includes a first member 12 having a first end 13 and a second end 14 and a second member 16 having a first end 17 adjacent to the first end 13 of the first member 12 and a second end 18 adjacent to the second end 14 of the first member 12. The second member 16 is substantially parallel to and spaced-apart from the first member 12 and there is a channel 15 formed therebetween. The channel 15 has a width 25 that is adjustably determined by the first adjustable link 30 that couples the first end 13 of the first member 12 to the first end 17 of the second member 16 and by the second adjustable link 32 that couples the second end 14 of the first member 12 to the second end 18 of the second member 16.

The adjustable links 30 and 32 may come in several various forms and are discussed in more detail below. In general, the adjustable links 30 and 32 are either continuously adjustable or adjustable in increments to adjust the width 25 of the channel 15 formed intermediate the first adjustable link 30 and second adjustable link 32 and intermediate the first member 12 and the second member 16 of the guide 10A of the end frame 10.

Figure 3:
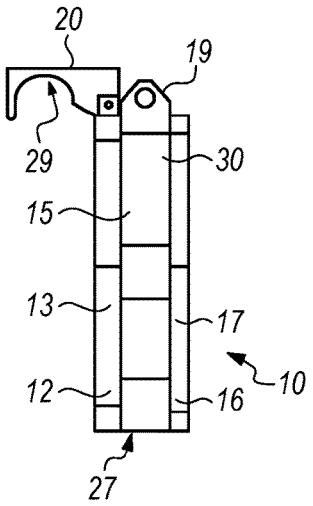
FIG. 3 is a side elevation view of the embodiment of the end frame of FIG. 1.

FIG. 3 is a side elevation view of the end frame 10 of FIG. 1. The side elevation view of FIG. 3 shows the first adjustable link 30 connected to the first end 13 of the first member 12 and to the adjacent first end 17 of the second member 16. FIG. 3 further shows the first hanger 20 having a recess 29 therein for receiving a spreader on a trench shield (not shown in FIG. 3) and for thereby supporting the guide 10A of the end frame 10 at and in engagement with the first ends of the sidewalls of the trench shield, as will be discussed and illustrated in more detail below. FIG. 3 shows the first adjustable link 30 that adjustably couples the first end 13 of the first member 12 to the first end 17 of the second member 16. The width 25 of the channel 15 can be adjusted using the adjustable links 30 and 32.

Figure 4:
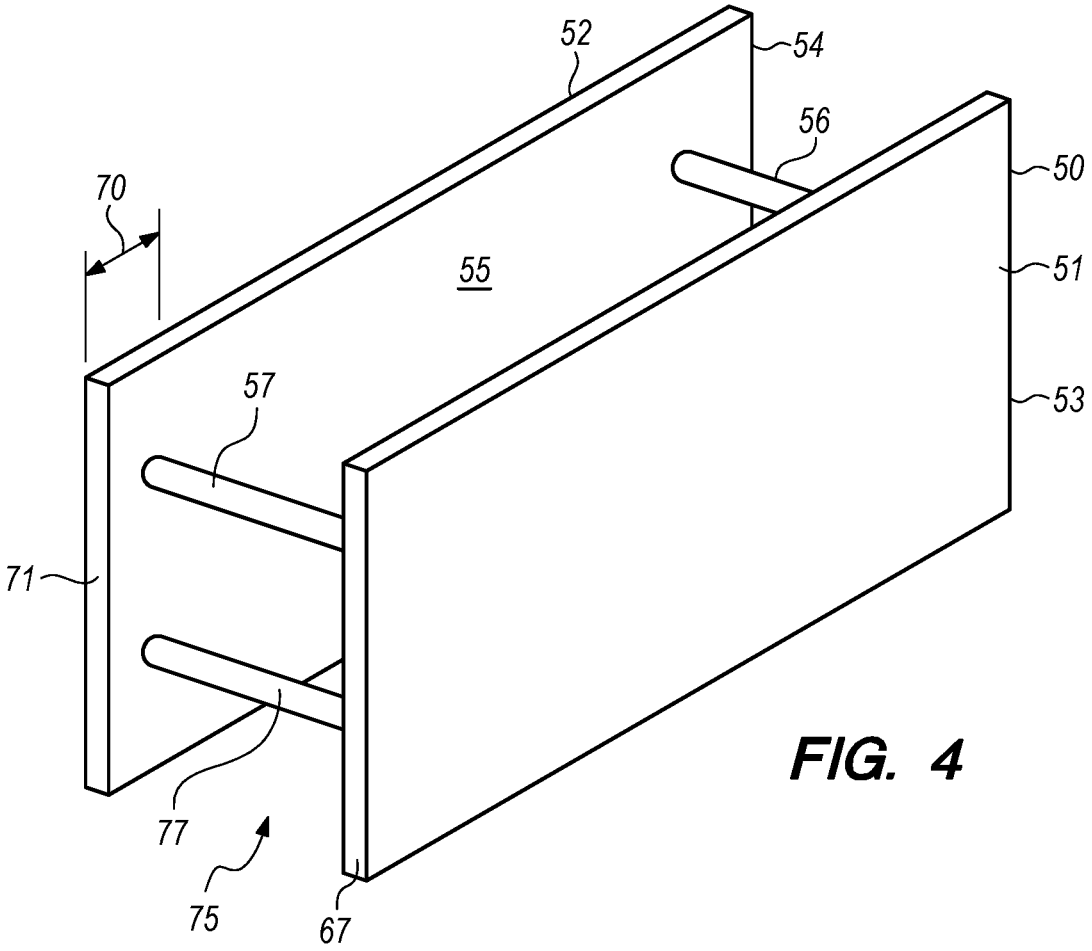
FIG. 4 is a perspective view of a conventional trench shield showing the positions of the two opposed sidewalls and the plurality of spreaders that engage and maintain the sidewalls in their spaced-apart and parallel relationship one relative to the other.

FIG. 4 is a perspective view of a conventional (prior art) trench shield 50 showing the positions of the first sidewall 52, the parallel and spaced-apart second sidewall 52, the first top spreader 56, the second top spreader 57, a first bottom spreader (not shown) and a second bottom spreader 77 that together maintain the first sidewall 51 and the second sidewall 52 in their parallel and spaced-apart relationship to maintain and protect a work space 55 therebetween. The first sidewall 51 has a first end 53 and a second end 67 and the second sidewall 52 has a first end 54 opposite the first end 53 of the first sidewall 51 and a second end 71 opposite the second end 67 of the first sidewall 51. The second top spreader 57 of the trench shield 50 shown in FIG. 4 is connected to the first sidewall 51 and to the second sidewall 52 a distance 70 from the second end 67 of the first sidewall 51 and from the second end 71 of the second sidewall 52.

Figure 5:
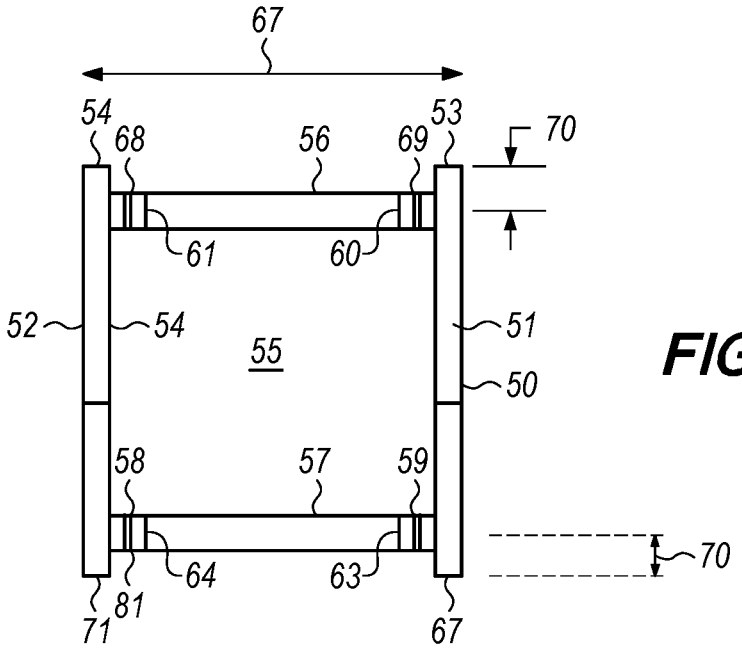
FIG. 5 is a sectional plan view of the trench shield of FIG. 4 showing a plurality of spreader supports protruding inwardly from the two opposed and parallel sidewalls of the trench shield and into the work space protected by the sidewalls of the trench shield, each spreader support received within an end of one of the plurality of tubular spreaders of the trench shield and secured into engagement with the spreader into which it is received with an inserted pin that is inserted through aligned holes in the spreader support and in the end of the tubular spreader into which the spreader support is received.

FIG. 5 is a sectional plan view of the trench shield 50 of FIG. 4 showing a plurality of spreader supports 60 and 63 protruding inwardly from the first sidewall 51 of the trench shield 50 and a plurality of spreader supports 61 and 64 protruding inwardly from the second sidewall 52 of the trench shield 50, the spreader supports 60, 61, 63 and 64 protruding from the first sidewall 51 and the second sidewall 52 into the work space 55 protected by the trench shield 50, each spreader support 60, 61, 63 and 64 received within an end 68, 69, 58 and 59 of one of the plurality of tubular spreaders 56 and 57 of the trench shield 50 and secured into engagement with the spreader 56 and/or 57 into which it is received with an inserted pin 81 inserted through aligned holes in the spreader support 60, 61, 63 and 64 and in the end of the spreader 56 and 57 into which the spreader support 60, 61, 63 and 64 is received. The spreader supports 60, 61, 63 and 64 are robustly coupled to the sidewalls 51 and 52 by, for example, welding. The spreader supports 60, 61, 63 and 64 are generally proximal to the ends 54, 71, 53 and 67 of the sidewalls 51 and 52 of the trench shield 50, as is also shown in FIG. 4.

Figure 6:
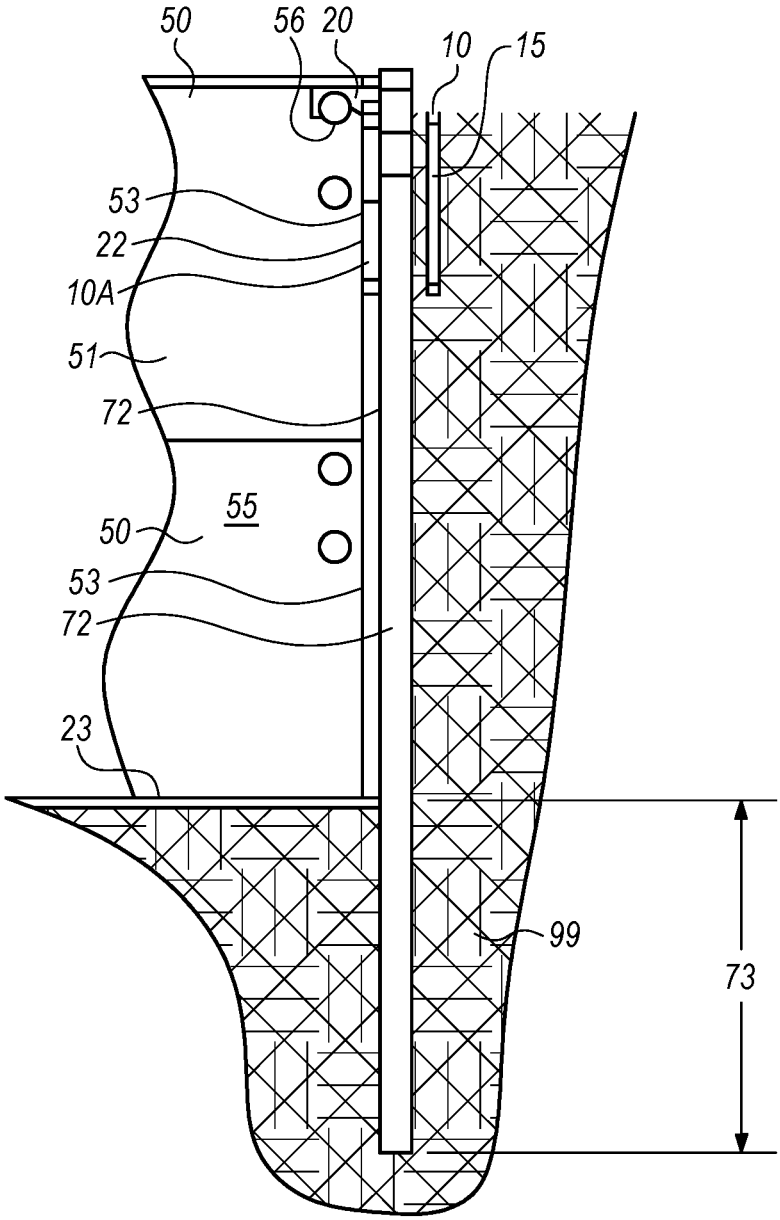
FIG. 6 is an elevation view of an embodiment of the end frame of FIGS. 1-3 coupled to a spreader of a conventional trench shield proximal to an end of the trench shield, a sheet piling having been driven through the channel of the guide of the end frame and into the soil therebelow to protect the work space within the interior of the trench shield from cave-ins of soil into the end of the trench shield at which the end frame is hung.

FIG. 6 is an elevation view of an embodiment of the end frame 10 of FIGS. 1-3 coupled and supported through a first hanger 20 and a second hanger 21 (not shown) to a spreader 56 proximal to a first end 53 of a sidewall 51 of a trench shield 50 proximal to the end of the trench shield 50, a sheet piling 72 having been driven through the channel 15 of the guide 10A of the end frame 10 to protect the work space 55 within the trench shield 50 from cave-ins of soil into the work space 55 of the trench shield 50. It will be noted that the trench shield 50 from which the embodiment of the end frame 10 in FIG. 6 is supported is stacked upon another trench shield 50 disposed thereunder. The sheet piling 72 is inserted through the channel 15 of the guide 10A of the end frame 10 and driven into the earth 99 (soil) at the bottom 23 of the trench a depth 73 to establish a "toe" that stabilizes the sheet piling 72 and thereby protects the work space 55. The soil 99 that engages and bears against the sheet piling 72 causes a reaction force by the sheet piling 72 back against the soil. This results in force being applied by the sheet piling 72 against the guide 10A of the end frame 10 that causes the load surfaces 22 of the end frame 10 being urged to bear against the first end 53 of the first sidewall 51 and the first end 54 of the second sidewall 52 (not shown) of the trench shield 50 having a spreader 56 from which the end frame 10 is hung using a first hanger 20 and a second hanger 21 (not shown in FIG. 6).

Figure 7:
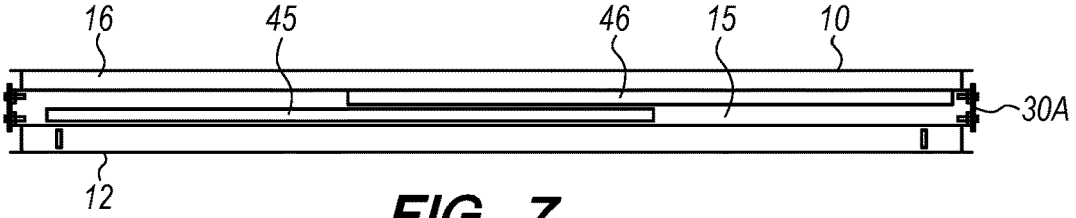
FIG. 7 is a plan view of an embodiment of the end frame of the present invention for being hung from a spreader of a trench shield (not shown) with two overlapping protective plates having been driven through the channel of the guide of the end frame to provide protection against cave-ins into a work space (not shown) intermediate the sidewalls of a trench shield (not shown).

FIG. 7 is a plan view of the embodiment of the end frame 10 for hanging from a spreader of a trench shield (not shown in FIG. 7) with two overlapping protective plates 45 and 46 having been driven through the channel 15 of the end frame 10 to provide protection against cave-ins into a work space (not shown in FIG. 7) intermediate the sidewalls of a trench shield (not shown in FIG. 7). The plates 45 and 46 are arranged in an overlapping configuration to prevent soil (not shown) from entering the work space 55.

Figure 8:
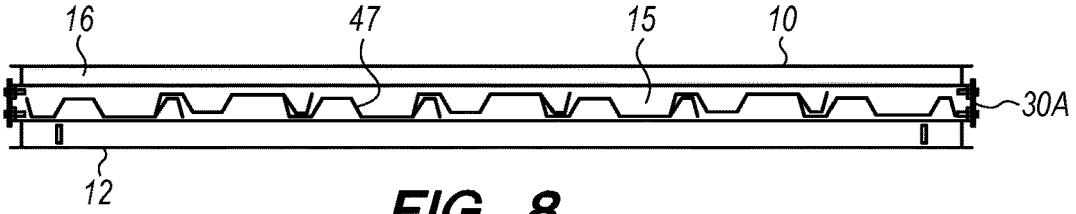
FIG. 8 is a plan view of the end frame of FIG. 7 with a first corrugated sheet piling having been driven through the channel of the guide of the end frame to provide protection against cave-ins into a work space (not shown) intermediate the sidewalls of a trench shield (not shown).

FIG. 8 is a plan view of the end frame 10 for hanging from a spreader of a trench shield (not shown in FIG. 8) with a first corrugated sheet piling 47 having been driven through the channel 15 of the end frame 10 to provide protection against cave-ins into a work space (not shown) intermediate the sidewalls of a trench shield (not shown). It will be understood that the corrugations of the sheet piling 47 provide enhanced stiffness and resistance to bending of the sheet piling 47.

Figure 9:
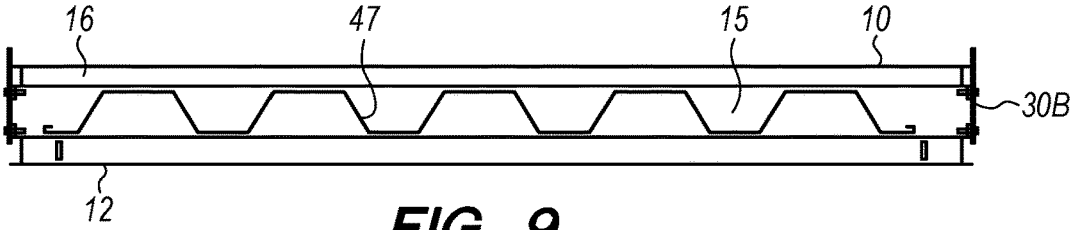
FIG. 9 is a plan view of the end frame of FIG. 7 with a second corrugated sheet piling having been driven through the channel of the guide of the end frame to provide protection against cave-ins into a work space (not shown) intermediate the sidewalls of a trench shield (not shown).

FIG. 9 is a plan view of the end frame 10 for hanging from a spreader of a trench shield (not shown in FIG. 9) with a second corrugated sheet piling 47 having been driven through the channel 15 of the end frame 10 to provide protection against cave-ins into a work space 55 (not shown) intermediate the sidewalls of a trench shield (not shown).

Figure 10:
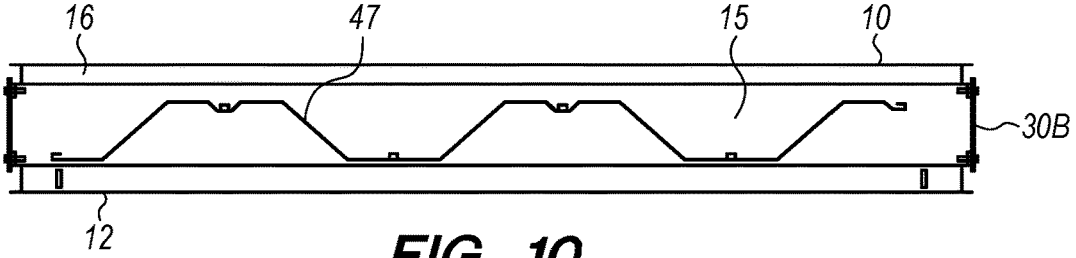
FIG. 10 is a plan view of the end frame of FIG. 7 with a third corrugated sheet piling having been driven through the channel of the guide of the end frame to provide protection against cave-ins into a work space (not shown) intermediate the sidewalls of a trench shield (not shown).

FIG. 10 is a plan view of the end frame 10 for hanging from a spreader of a trench shield (not shown in FIG. 10) with a third corrugated sheet piling 47 having been driven through the channel 15 of the end frame to provide protection against cave-ins into a work space (not shown) intermediate the sidewalls of a trench shield (not shown).

Figure 11:
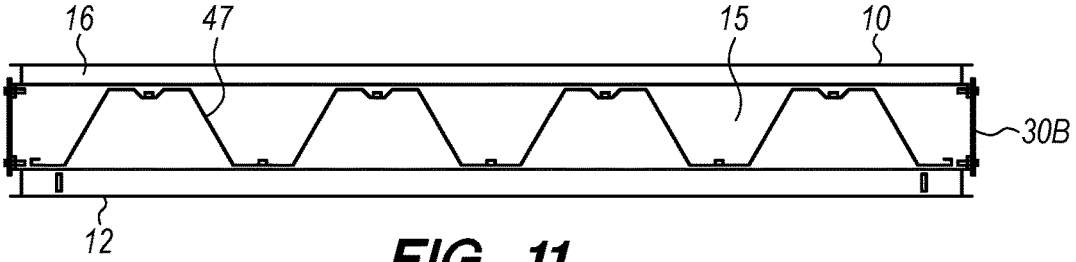
FIG. 11 is a plan view of the end frame of FIG. 7 with a fourth corrugated sheet piling having been driven through the channel of the guide of the end frame to provide protection against cave-ins into a work space (not shown) intermediate the sidewalls of a trench shield (not shown).

FIG. 11 is a plan view of the end frame 10 for hanging from a spreader of a trench shield (not shown in FIG. 11) with a fourth corrugated sheet piling 47 having been driven through the channel 15 of the end frame 10 to provide protection against cave-ins into a work space (not shown) intermediate the sidewalls of a trench shield (not shown).

Figure 12:
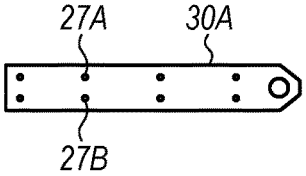
FIG. 12 is an elevation view of a first linking plate that can be used to couple a first end of a first member of an embodiment of the end frame of the present invention to a first end of a second member.

FIG. 12 is a first linking plate 30A that can be used to couple a first end 13 of a first member 12 (not shown in FIG. 12) of an embodiment of the end frame 10 of the present invention to a first end 17 of a second member 16 (not shown in FIG. 12). The linking plate 30A of FIG. 12 has a first column 27A of fastener components and a second column of fastener components 27B arranged in a side-by-side configuration on the linking plate 30A, the first column 27A of fastener components for coupling to a first end 13 of a first member 12 of a guide 10A of an end frame 10 and the second column 27B of fastener components for coupling to a first end 17 of a second member 16 of a guide 10A of an end frame 10 to secure the first end 13 of a first member 12 of a guide 10A of an end frame 10 in a spaced-apart relationship from the first end 17 of a second member 16 of a guide 10A of an end frame 10. In the embodiment of the linking plate 30A shown in FIG. 12, the fastener components are apertures or holes for receiving threaded bolts, but in other embodiments they may be other fastener components.

Figure 13:
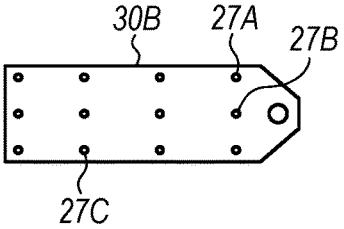
FIG. 13 is an elevation view of a second, larger linking plate that can be used to couple a first end of a first member of an embodiment of the end frame of the present invention to a first end of a second member, the larger linking plate being adapted for varying the width of the channel of the end frame.

FIG. 13 is a second, larger linking plate 30B that can be used to couple a first end 13 of a first member 12 of the guide 10A of the end frame 10 of the present invention to a first end 17 of a second member 16 of the guide 10A of the end frame 10, the larger linking plate 30B being adapted for varying the width of the channel 15 of the guide 10A end frame 10. The linking plate 30B of FIG. 13 includes a first column 27A of fastener components, a second column of fastener components 27B and a third column of fastener components 27C arranged in a side-by-side-by-side configuration on the linking plate 30B, the first column 27A of fastener components for coupling to a first end 13 of a first member 12 of a guide 10A of an end frame 10 and one of the second column 27B and the third column 27C of fastener components for coupling to a first end 17 of a second member 16 of a guide 10A of an end frame 10 to secure the first end 13 of a first member 12 of a guide 10A of an end frame 10 in a spaced-apart relationship from the first end 17 of a second member 16 of a guide 10A of an end frame 10. In the embodiment of the linking plate 30B shown in FIG. 13, the fastener components are apertures or holes for receiving threaded bolts, but in other embodiments they may be other fastener components. It will be understood that the selection of either the second column 27B or the third column 27C for use in coupling the linking plate 30B to the first end 17 of the second member 16 of the guide 10A of the end frame 10 will determine the width of the channel 15 of the guide 10A of the end frame 10, thereby allowing adjustment of the width of the channel 15 of a guide 10A comprising the linking plate 30B of FIG. 13.

Figure 14:
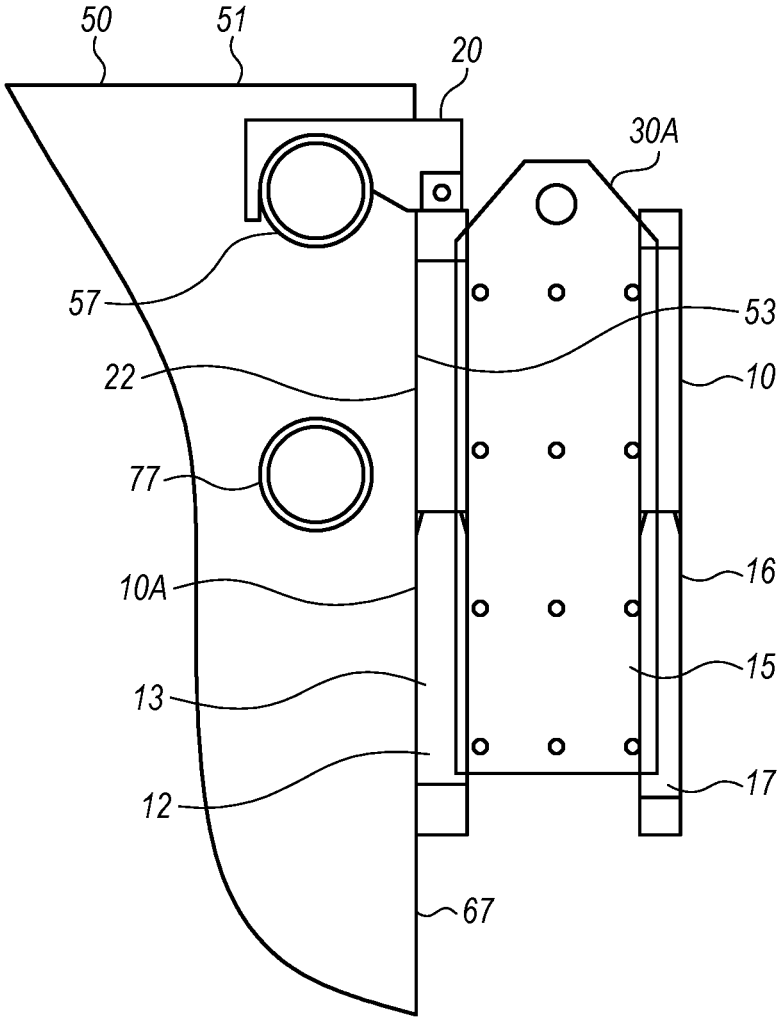
FIG. 14 is a sectional elevation view of a trench shield having a spreader from which an embodiment of an end frame of the present invention is hung to cause the load surfaces of the first member of the guide of the end frame to bear against the first ends of the sidewalls of the trench shield to align the channel of the end frame with the ends of the sidewalls of the trench shield.

FIG. 14 is a sectional elevation view showing an embodiment of an end frame 10 of the present invention hung from a spreader 57 of a trench shield 50 to cause the load surfaces 22 of the guide 10A of the end frame 10 to bear against the first end 53 of the first sidewall 51 and against the first end 54 of the second sidewall 52 (not shown in FIG. 14) of the trench shield 50 and to align the channel 15 of the guide 10A of the end frame 10 with the first end 53 of the first sidewall 51 and against the first end 54 of the second sidewall 52 (not shown in FIG. 14) of the trench shield 50. It will be noted that the linking plate 30B includes three columns of fastener components to make the channel 15 of the guide 10A of the end frame 10 adjustable in width.

Figure 15:
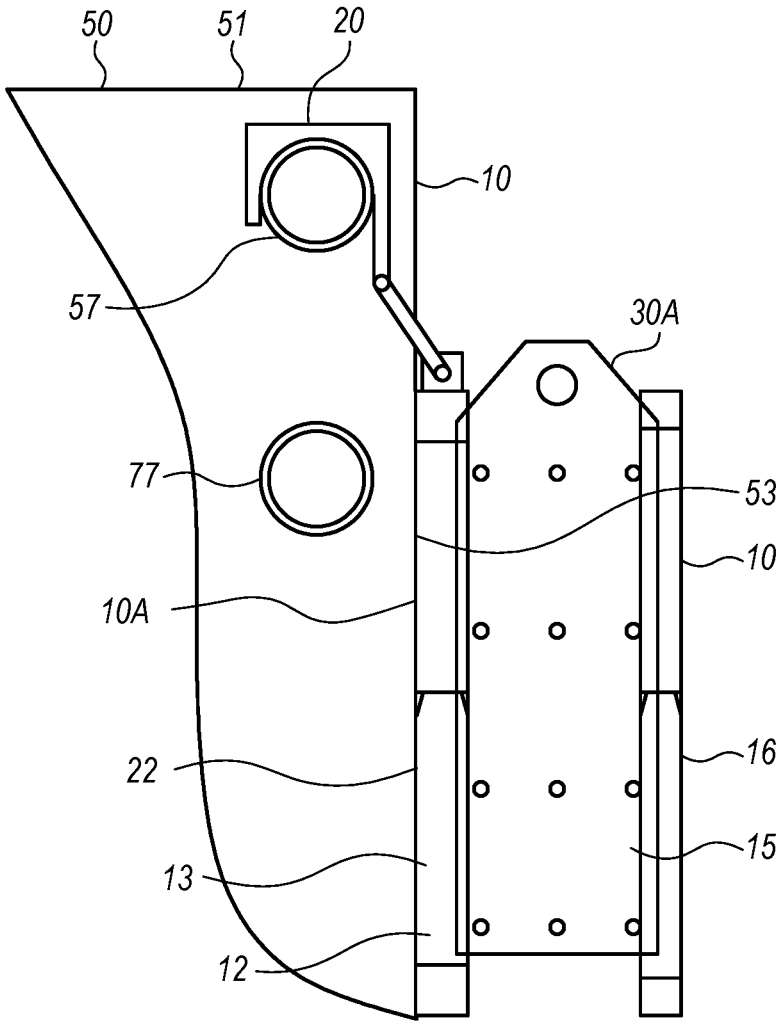
FIG. 15 is a sectional elevation view showing an alternate embodiment of an end frame of the present invention hung from a spreader of a trench shield to cause the load surfaces of the first member of the guide of the end frame to bear against the ends of the sidewalls of the trench shield and to align the channel of the end frame with the ends of the sidewalls of the trench shield.

FIG. 15 is a sectional elevation view showing an alternate embodiment of an end frame 10 of the present invention hung from a spreader 57 of a trench shield 50 to cause the load surfaces 22 of the guide 10A of the end frame 10 to bear against the first end 53 of the first sidewall 51 and against the first end 54 of the second sidewall 52 (not shown in FIG. 15) of the trench shield 50 and to align the channel 15 of the guide 10A of the end frame 10 with the first end 53 of the first sidewall 51 and against the first end 54 of the second sidewall 52 (not shown in FIG. 15) of the trench shield 50. It will be noted that the linking plate 30B includes three columns of fastener components to make the channel 15 of the guide 10A of the end frame 10 adjustable in width.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the invention.

The corresponding structures, materials, acts, and equivalents of all means or steps plus function elements in the claims below are intended to include any structure, material, or act for performing the function in combination with other claimed elements as specifically claimed. The description of the present invention has been presented for purposes of illustration and description, but it is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. An apparatus for use with a trench shield, comprising:

a guide channel having a first member having a first end and a second end, the first member further including an exterior side and an interior side, the exterior side having a pair of load surfaces spaced-apart one from the other by a first distance, the guide channel further including a second member having a first end and a second end, the second member further including an exterior side and an interior side, the interior side of the second member disposed toward and spaced-apart from the interior side of the first member, the guide channel further including a first adjustable link coupling the first end of the second member to the first end of the first member and a second adjustable link coupling the second end of the second member to the second end of the first member, the first and second adjustable links being adjustable to vary the separation between the first member and the second member and between the interior side of the first member and the interior side of the second member to form an adjustable channel surrounded by the interior side of the first member, the interior side of the second member, the first adjustable link and the second adjustable link;

a first hanger extending outwardly from the guide channel beyond the exterior side of the first member, the first hanger being proximal to the first end of the first member; and a second hanger extending outwardly from the guide channel beyond the exterior side of the first member, the second hanger being proximal to the second end of the first member, the second hanger being spaced-apart from the first hanger by a second distance that is less than the first distance;

wherein the apparatus is securable to an end of a trench shield by hanging the first hanger onto a first end of a spreader of the trench shield and the second hanger onto a second end of the spreader to dispose the first engaging surface against an end of a first sidewall of the trench shield at a location below the first end of the spreader and to dispose the second engaging surface against an adjacent end of a second sidewall of the trench shield at a location below the second end of the spreader; and wherein the channel is adjustable to receive a range of sizes of sheet pilings therethrough to be driven into the earth adjacent to the spreader of the trench shield to prevent unwanted cave-ins of soil into an end of a space between the first and second sidewalls of the trench shield.

2. The apparatus of claim 1, wherein the first member is a planar panel.

3. The apparatus of claim 2, wherein the second member is a planar panel.

4. The apparatus of claim 1, wherein the first hanger is coupled to the guide channel by a link and the second hanger is coupled to the guide channel by a link.

5. The apparatus of claim 4, wherein the first hanger is coupled to the guide channel by a flexible link; and wherein the second hanger is coupled to the guide channel by a flexible link.

6. The apparatus of claim 5, wherein the first hanger is coupled to the guide channel by a flexible link comprising one of a belt, a chain and a cable; and wherein the second hanger is coupled to the guide channel by a flexible link comprising one of a belt, a chain and a cable.

7. The apparatus of claim 4, wherein the first hanger is coupled to the guide channel by a rigid link; and wherein the second hanger is coupled to the guide channel by a rigid link.

8. The apparatus of claim 7, wherein the first hanger is coupled to the guide channel by a rigid, pivoting link that is pivotally coupled at a first end to the first hanger and pivotally coupled at a second end to the guide channel; and wherein the second hanger is coupled to the guide channel by a rigid, pivoting link that is pivotally coupled at a first end to the second hanger and pivotally coupled at a second end to the guide channel.

9. The apparatus of claim 8, wherein the first hanger is coupled to the guide channel by a parallelogram link that is pivotally coupled at a first end to the first hanger and pivotally coupled at a second end to the guide channel; and wherein the second hanger is coupled to the guide channel by a parallelogram link that is pivotally coupled at a first end to the second hanger and pivotally coupled at a second end to the guide channel.

10. An apparatus for use with a trench shield, comprising:

a guide channel having a first member having a first end and a second end, the first member further including an exterior side and an interior side, the exterior side having a pair of load surfaces spaced-apart one from the other by a first distance, the guide channel further including a second member having a first end and a second end, the second member further including an exterior side and an interior side, the interior side of the second member disposed toward and spaced-apart from the interior side of the first member, the guide channel further including a first end member coupled to the first end of the second member and to the first end of the first member and a second end member coupled to the second end of the second member and to the second end of the first member, the first and second end members and the first and second members together forming a channel surrounded by the interior side of the first member, the interior side of the second member, and the first end member and the second end member;

a first hanger extending outwardly from the guide channel beyond the exterior side of the first member, the first hanger being proximal to the first end of the first member; and a second hanger extending outwardly from the guide channel beyond the exterior side of the first member, the second hanger being proximal to the second end of the first member, the second hanger being spaced-apart from the first hanger by a second distance that is less than the first distance;

wherein the apparatus is securable to an end of a trench shield by hanging the first hanger onto a first end of a spreader of the trench shield and the second hanger onto a second end of the spreader to dispose the first engaging surface against an end of a first sidewall of the trench shield at a location below the first end of the spreader and to dispose the second engaging surface against an adjacent end of a second sidewall of the trench shield at a location below the second end of the spreader; and wherein the channel receives a range of sizes of sheet pilings therethrough to be driven into the earth adjacent to the spreader of the trench shield to prevent unwanted cave-ins of soil into an end of a space between the first and second sidewalls of the trench shield.

11. The apparatus of claim 10, wherein the first member is a planar panel.

12. The apparatus of claim 11, wherein the second member is a planar panel.

13. The apparatus of claim 10, wherein the first hanger is coupled to the guide channel by a link and the second hanger is coupled to the guide channel by a link.

14. The apparatus of claim 13, wherein the first hanger is coupled to the guide channel by a flexible link; and wherein the second hanger is coupled to the guide channel by a flexible link.

15. The apparatus of claim 14, wherein the first hanger is coupled to the guide channel by a flexible link comprising one of a belt, a chain and a cable; and wherein the second hanger is coupled to the guide channel by a flexible link comprising one of a belt, a chain and a cable.

16. The apparatus of claim 13, wherein the first hanger is coupled to the guide channel by a rigid link; and wherein the second hanger is coupled to the guide channel by a rigid link.

17. The apparatus of claim 16, wherein the first hanger is coupled to the guide channel by a rigid, pivoting link that is pivotally coupled at a first end to the first hanger and pivotally coupled at a second end to the guide channel; and wherein the second hanger is coupled to the guide channel by a rigid, pivoting link that is pivotally coupled at a first end to the second hanger and pivotally coupled at a second end to the guide channel.

18. The apparatus of claim 17, wherein the first hanger is coupled to the guide channel by a parallelogram link that is pivotally coupled at a first end to the first hanger and pivotally coupled at a second end to the guide channel; and wherein the second hanger is coupled to the guide channel by a parallelogram link that is pivotally coupled at a first end to the second hanger and pivotally coupled at a second end to the guide channel.

19. An apparatus for use with a trench shield, comprising:

a guide channel having a first member having a first end and a second end, the first member further including an exterior side and an interior side, the exterior side having a pair of load surfaces spaced-apart one from the other by a first distance, the guide channel further including a second member having a first end and a second end, the second member further including an exterior side and an interior side, the interior side of the second member disposed toward and spaced-apart from the interior side of the first member, the guide channel further including a first end member coupled to the first end of the second member and to the first end of the first member and a second end member coupled to the second end of the second member and to the second end of the first member, the first and second end members and the first and second members together forming a channel surrounded by the interior side of the first member, the interior side of the second member, and the first end member and the second end member;

at least one hanger extending outwardly from the guide channel beyond the exterior side of the first member; and wherein the apparatus is securable to an end of a trench shield by hanging the at least one hanger onto a spreader of the trench shield to dispose the first engaging surface against an end of a first sidewall of the trench shield at a location below the spreader and to dispose the second engaging surface against an adjacent end of a second sidewall of the trench shield at a location below the spreader; and wherein the channel receives a range of sizes of sheet pilings therethrough to be driven into the earth adjacent to the spreader of the trench shield to prevent unwanted cave-ins of soil into an end of a space between the first and second sidewalls of the trench shield.

* * * * *